US007784560B2

(12) United States Patent
Mina et al.

(10) Patent No.: US 7,784,560 B2
(45) Date of Patent: Aug. 31, 2010

(54) CAP ASSEMBLY OF A FASTENER-DRIVING TOOL HAVING SWITCH MECHANISM INCORPORATED THEREIN FOR SWITCHING MODES OF OPERATION OF THE FASTENER-DRIVING TOOL

(75) Inventors: Nathan T. Mina, Lake In The Hills, IL (US); Genaro Cortez, Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 185 days.

(21) Appl. No.: 12/078,469

(22) Filed: Mar. 31, 2008

(65) Prior Publication Data

US 2009/0242604 A1 Oct. 1, 2009

(51) Int. Cl.
*B25C 1/04* (2006.01)

(52) U.S. Cl. ..... 173/1; 173/171; 173/218; 173/48

(58) Field of Classification Search ..... 227/8, 227/130, 156; 173/1, 171, 218, 48
See application file for complete search history.

(56) References Cited

U.S. PATENT DOCUMENTS 3,278,104 A 10/1966 Becht et al.
D219,259 S * 11/1970 Perkins ..... D8/61
3,561,324 A 2/1971 Obergfell
3,784,077 A * 1/1974 Burke et al. ..... 227/8
3,964,659 A 6/1976 Eiben et al.
4,436,237 A 3/1984 Vornberger et al.
4,550,643 A 11/1985 Schwartzenberger
4,573,624 A 3/1986 Muller et al.
4,629,106 A 12/1986 Howard et al.
4,679,719 A 7/1987 Kramer
4,915,013 A 4/1990 Moraht et al.
5,083,694 A 1/1992 Lemos
D338,606 S * 8/1993 Oda ..... D8/69
5,263,842 A 11/1993 Fealey
5,366,132 A 11/1994 Simonelli (Continued)

FOREIGN PATENT DOCUMENTS

EP 1223009 7/2002

(Continued)

*Primary Examiner*—Brian D Nash
(74) *Attorney, Agent, or Firm*—Law Offices of Steven W. Weinrieb

(57) ABSTRACT

A fastener-driving tool is provided with a cap assembly which includes a switch mechanism that permits the tool to be operated in one of two firing modes of operation. The switch mechanism comprises a two-position switch mechanism such that when the switch mechanism is disposed at a first one of its two positions, the tool will be able to operate in a fully automatic continuous firing mode of operation so as to continuously fire fasteners into a substrate as long as the workpiece contact element and the trigger mechanism are disposed at their depressed positions, or alternatively, when the switch mechanism is disposed at the second one of the two positions, the tool can be operated in a one-shot firing mode such that the tool can only fire a single fastener, either in accordance with, for example, a sequential-firing mode of operation or a bump-firing mode of operation, until the trigger mechanism is released and again depressed.

20 Claims, 6 Drawing Sheets

U.S. PATENT DOCUMENTS 5,522,532 A 6/1996 Chen
5,551,620 A 9/1996 Vallee
5,551,621 A 9/1996 Vallee
5,597,106 A 1/1997 Hamano et al.
5,605,268 A 2/1997 Hayashi et al.
5,653,369 A 8/1997 White
5,669,541 A 9/1997 Ronconi
5,671,880 A 9/1997 Ronconi
5,687,897 A 11/1997 Fa et al.
5,732,870 A 3/1998 Moorman et al.
5,785,228 A 7/1998 Fa et al.
5,791,545 A 8/1998 Lin
D406,999 S * 3/1999 Sover et al. ..... D8/69
5,896,933 A 4/1999 White
5,918,788 A 7/1999 Moorman et al.
6,116,488 A 9/2000 Lee
D435,770 S * 1/2001 Arai ..... D8/68
6,176,321 B1 * 1/2001 Arakawa et al. ..... 173/48
6,176,412 B1 * 1/2001 Weinger et al. ..... 227/142
6,186,386 B1 * 2/2001 Canlas et al. ..... 227/142
6,213,372 B1 4/2001 Chen
6,223,963 B1 * 5/2001 Aparacio, Jr. ..... 227/8
6,357,647 B1 3/2002 Ou
6,371,348 B1 4/2002 Canlas et al.
6,382,492 B1 5/2002 Moorman et al.
6,419,140 B1 7/2002 Chen
6,422,446 B1 7/2002 Liu
6,431,425 B1 8/2002 Moorman et al.
6,543,664 B2 4/2003 Wolfberg
6,581,814 B1 6/2003 Hsu
6,584,945 B2 * 7/2003 Porth ..... 123/169 EL
6,588,642 B1 7/2003 Wang et al.
6,592,014 B2 * 7/2003 Smolinski ..... 227/8
D477,976 S * 8/2003 Liu ..... D8/68
6,604,664 B2 8/2003 Robinson
6,659,324 B1 12/2003 Liu
6,662,989 B1 12/2003 Chang et al.
6,675,999 B2 1/2004 Mukoyama et al.
6,722,547 B1 4/2004 Wang et al.
6,726,080 B2 * 4/2004 Hamada ..... 227/120
6,786,378 B2 * 9/2004 Wagdy et al. ..... 227/9
6,886,729 B1 5/2005 Lee
6,913,090 B2 * 7/2005 Droste et al. ..... 173/109
6,929,165 B1 8/2005 Chen et al.
D531,475 S * 11/2006 Li ..... D8/69
7,143,918 B2 12/2006 Aguirre et al.
7,163,134 B2 1/2007 Moeller et al.
7,191,927 B2 3/2007 Segura
D540,136 S * 4/2007 Aguirre et al. ..... D8/69
7,213,733 B1 5/2007 Wen
7,322,426 B2 1/2008 Aguirre et al.
7,617,957 B2 * 11/2009 Holderfield et al. ..... 227/10
2002/0035876 A1 * 3/2002 Donaldson, Jr. ..... 73/862.21
2002/0104868 A1 * 8/2002 Miller et al. ..... 227/130
2003/0132264 A1 * 7/2003 Smolinski ..... 227/130
2005/0001007 A1 * 1/2005 Butzen et al. ..... 227/130
2006/0060628 A1 * 3/2006 Larkin et al. ..... 227/10
2008/0035212 A1 * 2/2008 Holderfield et al. ..... 137/377

FOREIGN PATENT DOCUMENTS

EP 1512495 3/2005
GB 1057288 2/1967
WO WO 2005/081999 9/2005

* cited by examiner

CAP ASSEMBLY OF A FASTENER-DRIVING TOOL HAVING SWITCH MECHANISM INCORPORATED THEREIN FOR SWITCHING MODES OF OPERATION OF THE FASTENER-DRIVING TOOL

FIELD OF THE INVENTION

The present invention relates generally to fastener-driving tools, and more particularly to a new and improved cap assembly of a fastener-driving tool having a new and improved switch mechanism incorporated therein wherein, for example, the new and improved switch mechanism comprises a two-position switch mechanism whereby when the switch mechanism is disposed at a first one of the two positions, the fastener-driving tool can be operated in a fully automatic continuous firing mode of operation by means of which the fastener-driving tool can continuously fire fasteners into a substrate or workpiece as long as the workpiece contact element is maintained at its engaged or depressed position against the workpiece or substrate, and as long as the trigger mechanism is likewise maintained at its actuated or depressed position, or alternatively, when the switch mechanism is disposed at a second one of the two positions, the fastener-driving tool can be operated in a one-shot firing mode by means of which the fastener-driving tool can only fire a single fastener either in accordance with, for example, a sequential-firing mode of operation or a bump-firing mode of operation. In addition, the new and improved cap assembly also has incorporated therein an adjustment mechanism such that when the switch mechanism is disposed at the first one of its two positions so as to permit the fastener-driving tool to be operated in its fully automatic continuous firing mode of operation, the rate at which the fastener-driving tool can be continuously fired can be adjusted.

BACKGROUND OF THE INVENTION

Various different types of fastener-driving tools are of course well-known in the art. For example, the fastener-driving tools may be electrically or electronically powered or controlled, combustion-powered, pneumatically powered, or the like. In addition, the fastener-driving tools may effectively incorporate various structure therewithin which permits the fastener-driving tools to be operated in accordance with different firing modes of operation. More particularly, for example, in accordance with a first single-shot firing mode of operation, which is known in the industry and art as a sequential mode of operation, the depression or actuation of the trigger mechanism will not in fact initiate the firing of the tool and the driving of a fastener into a workpiece or substrate unless the workpiece-contacting element is initially depressed against the substrate or workpiece. Considered from a different point of view or perspective, in order to operate the fastener-driving tool in accordance with the sequential mode of operation, the workpiece contacting element must first be depressed against the workpiece or substrate followed by the depression or actuation of the trigger mechanism. Still further, once a fastener has in fact been driven into the workpiece or substrate, further or repeated depression or actuation of the trigger mechanism will not result in the subsequent driving of additional fasteners into the workpiece or substrate unless, and until, the workpiece contacting element is permitted to be effectively reset to its original position and once again disposed in contact with, and pressed against, the workpiece or substrate prior to the depression or actuation of the trigger mechanism each time the tool is to be fired so as to drive a fastener into the workpiece or substrate.

Alternatively, in accordance with a second single-shot firing mode of operation, which is known in the industry and art as a bump-firing mode of operation, the operator initially maintains the trigger mechanism at its depressed position, and subsequently, each time the workpiece contacting element is disposed in contact with, and pressed against, the workpiece or substrate, the tool will fire, thereby driving a fastener into the workpiece or substrate. Still yet further, in accordance with a third fully automatic continuous firing mode of operation, as long as the workpiece contact element is maintained in contact with, and pressed against, the workpiece or substrate, and as long as the trigger mechanism is maintained at its depressed position, the fastener-driving tool will automatically and continuously fire fasteners into the workpiece or substrate. Unfortunately, conventional fastener-driving tools do not have incorporated therewithin a simple mechanism for effectively altering the mode of operation of the fastener-driving tool between, for example, either one of the first or second single-shot firing modes of operation and the third fully automatic continuous firing mode of operation.

A need therefore exists in the art for a new and improved switch mechanism which can be easily incorporated into, for example, the cap structure of a fastener-driving tool, even in a retro-fitted manner, whereby the mode of operation of the fastener-driving tool can be easily, readily, and quickly selected or altered between, for example, a single-shot firing mode of operation and a fully-automatic continuous firing mode of operation.

SUMMARY OF THE INVENTION

The foregoing and other objectives are achieved in accordance with the teachings and principles of the present invention through the provision of a fastener-driving tool which is provided with a new and improved cap assembly which has incorporated therein a new and improved switch mechanism which permits the fastener-driving tool to be operated in one of two firing modes of operation. The new and improved switch mechanism comprises a two-position switch mechanism such that when the new and improved switch mechanism is disposed at a first one of its two positions, the fastener-driving tool will be able to operate in a fully automatic continuous firing mode of operation by means of which the fastener-driving tool can continuously fire fasteners into a substrate or workpiece as long as the workpiece contact element is maintained at its engaged or depressed position against the workpiece or substrate, and as long as the trigger mechanism is likewise maintained at its actuated or depressed position, or alternatively, when the new and improved switch mechanism is disposed at a second one of the two positions, the fastener-driving tool can be operated in a one-shot firing mode by means of which the fastener-driving tool can only fire a single fastener either in accordance with, for example, a sequential-firing mode of operation or a bump-firing mode of operation. In addition, the new and improved cap assembly also has incorporated therein an adjustment mechanism such that when the switch mechanism is disposed at the first one of its two positions so as to permit the fastener-driving tool to be operated in its fully automatic continuous firing mode of operation, the rate at which the fastener-driving tool can be continuously fired can be adjusted.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
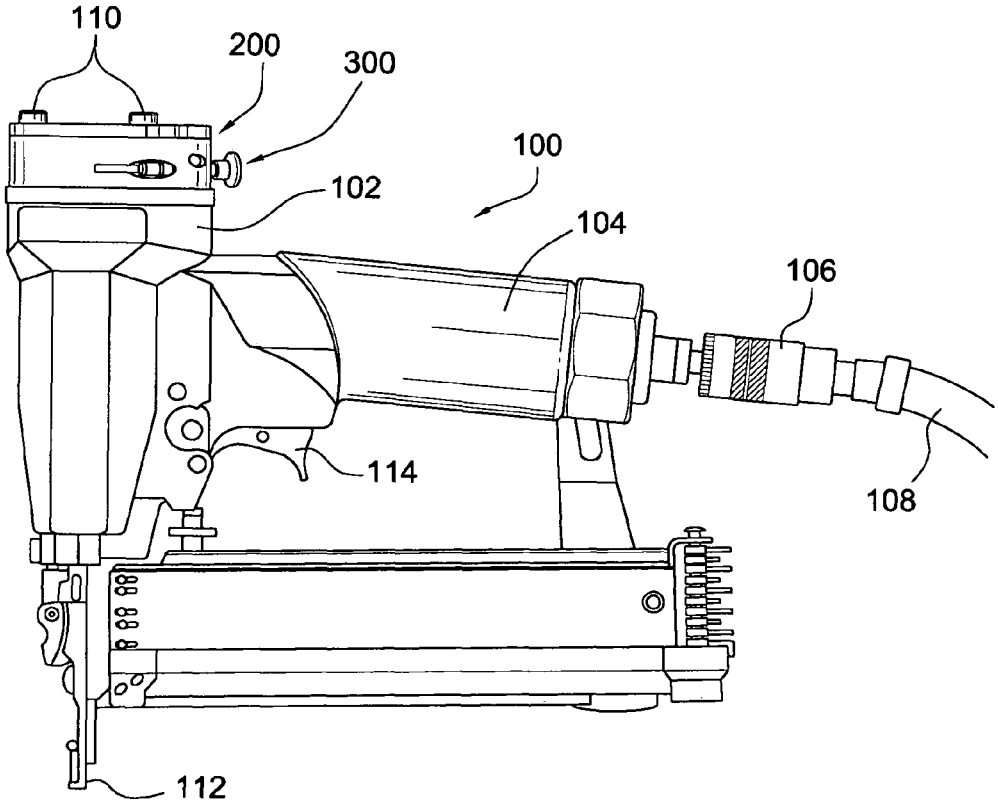
FIG. 1 is a side elevational view of a fastener-driving tool having the new and improved cap assembly with the new and improved switch mechanism incorporated therein, and as constructed in accordance with the principles and teachings of the present invention, mounted thereon.

Referring now to the drawings, and more particularly to FIG. 1 thereof, the upper end portion of a new and improved fastener-driving tool is disclosed and is generally indicated by the reference character 100. More particularly, the fastener-driving tool 100 is seen to comprise an upper housing portion 102 within which there is defined a cylinder, not shown, in which there is disposed a working piston, also not shown, having a driver blade mechanism or the like, also not shown, which is conventionally used to drive a fastener out from the fastener-driving tool 100 and into a workpiece or substrate. The upper housing portion 102 has a handle member 104 integrally formed or connected thereto, and a compressed air connector 106 is operatively connected to the handle member 104 so as to operatively and fluidically attach a compressed air line 108, leading from a suitable source of compressed air, not shown, to the fastener-driving tool 100.

In addition, it is also seen that, in accordance with the principles and teachings of the present invention, a new and improved cap assembly, generally indicated by the reference character 200, is adapted to be fixedly secured to the upper housing portion 102 by means of, for example, a plurality of suitable bolt fasteners 110, and still further, and likewise in accordance with the principles and teachings of the present invention, a new and improved switch mechanism, generally indicated by the reference character 300, is adapted to be movably disposed within, and with respect to, the new and improved cap assembly 200 in order to selectively determine the particular mode of operation in which the fastener-driving tool 100 is operating, that is, whether or not the fastener-driving tool 100 is being operated in accordance with its fully automatic continuous firing mode of operation by means of which the fastener-driving tool can continuously fire fasteners into a substrate or workpiece as long as the workpiece contact element 112 is maintained at its engaged or depressed position against the workpiece or substrate, and as long as the trigger mechanism 114 is likewise maintained at its actuated or depressed position, or alternatively, whether or not the fastener-driving tool 100 is being operated in accordance with its one-shot firing mode by means of which the fastener-driving tool can only fire a single fastener either in accordance with, for example, a sequential-firing mode of operation or a bump-firing mode of operation.

Figure 2:
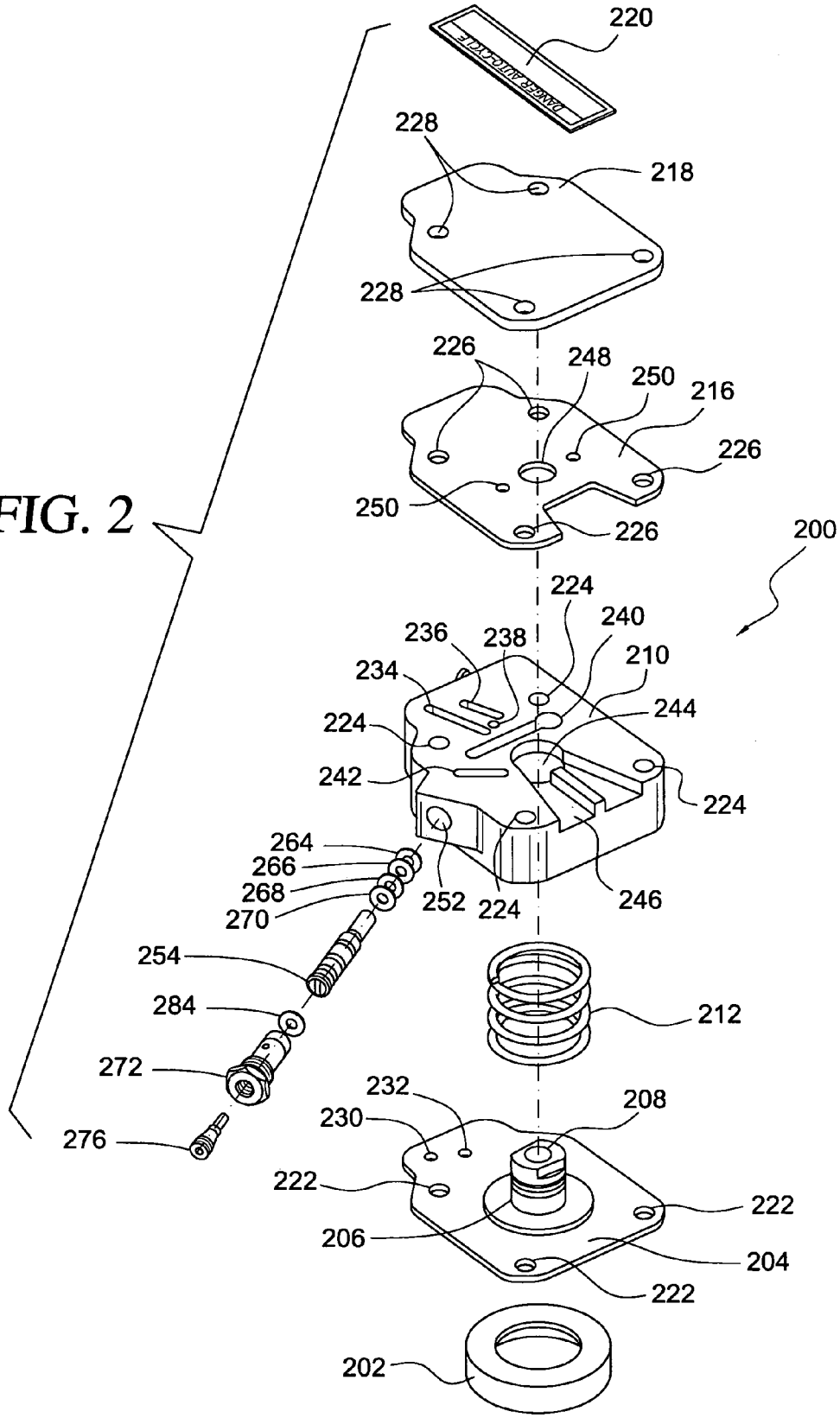
FIG. 2 is an exploded view of the new and improved cap assembly of the present invention as constructed in accordance with the principles and teachings of the present invention and showing the cooperative parts thereof.
Figure 3:
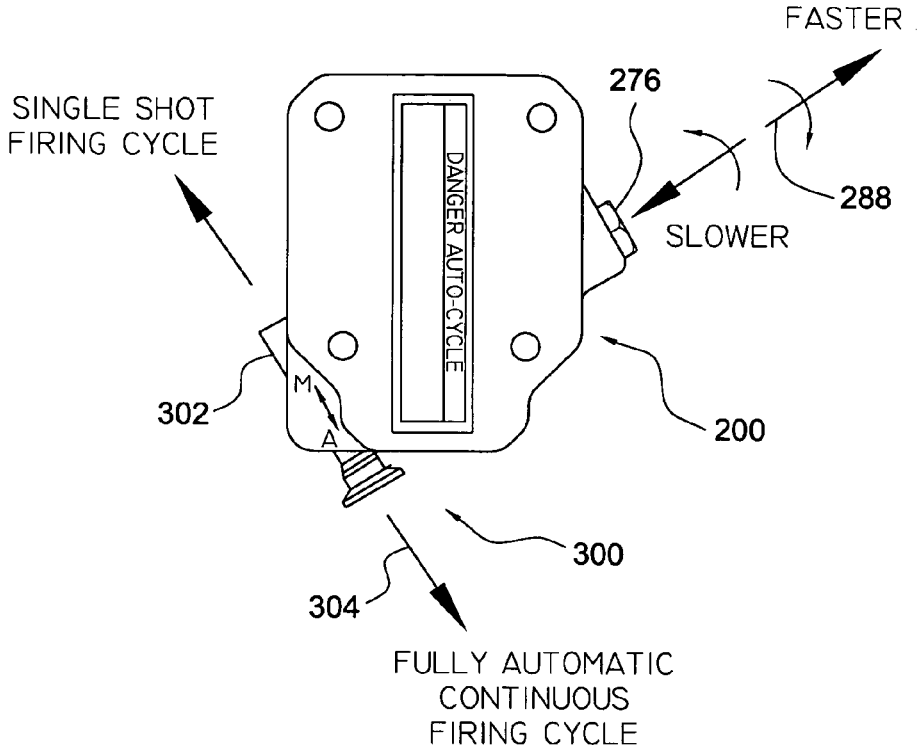
FIG. 3 is a top plan view of the new and improved cap assembly of the present invention showing the disposition of the new and improved two-position switch mechanism incorporated therein, as well as the adjustment mechanism incorporated therein for adjusting the rate of speed at which the fastener-driving tool will fire fasteners when the fastener-driving tool is disposed in its fully automatic continuous firing mode of operation.
Figure 4:
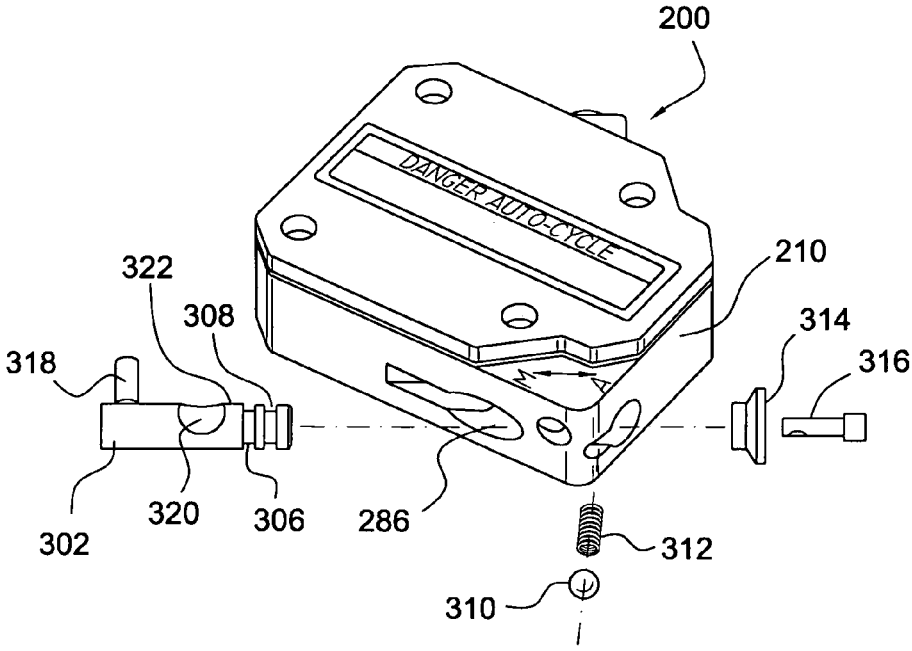
FIG. 4 is a partially exploded perspective view of the new and improved cap assembly as illustrated within FIG. 3 showing the component parts of the new and improved switch mechanism as incorporated within the new and improved cap assembly.

With reference now being made to FIGS. 2-4, it is seen that the new and improved cap assembly 200, as has been constructed in accordance with the principles and teachings of the present invention, comprises a rubber gasket 202 which is adapted to be seated upon the cylinder, not shown, which houses the working piston, also not shown, to which the fastener driver blade mechanism or the like, also not shown, is operatively connected. A substantially flexible diaphragm member 204 is adapted to be disposed above the rubber gasket 202, and it is seen that the diaphragm member 204 is provided at a substantially central portion thereof with an upstanding post 206 which has an axially oriented exhaust passage 208 defined therein which is fluidically connected to the under-surface portion of the diaphragm member 204. A cap member 210 is adapted to be disposed atop the diaphragm member 204, and a coil spring 212 is adapted to be interposed between the diaphragm member 204 and the cap member 210 such that a lower end portion of the coil spring 212 is disposed around the upstanding post 206 while an upper end portion of the coil spring 212 is adapted to be disposed or seated within a recessed or counterbored region 214 defined within an undersurface portion of the cap member 210 as can be seen, for example, within any one of FIGS. 5-7. In turn, a cap gasket 216 is adapted to be disposed atop the cap member 210, and a cap cover 218 is adapted to be disposed atop the cap gasket 216, while an indicia label 220 is adapted to be fixedly attached to and upon the upper external surface portion of the cap cover 218. It is also seen that the diaphragm member 204, the cap member 210, the cap gasket 216, and the cap cover 218 all have a substantially square-shaped configuration, and that all of the components 204, 210, 216, 218 respectively have a plurality of through-bores 222, 224, 226, 228 defined within corner regions thereof for accommodating the bolt fasteners 110 whereby all of the components 204, 210, 216, 218 are able to be fixedly secured together so as to effectively form the new and improved cap assembly 200, as well as to fixedly secure the new and improved cap assembly 200 to the upper housing portion 102 of the fastener-driving tool 100.

Figure 5:
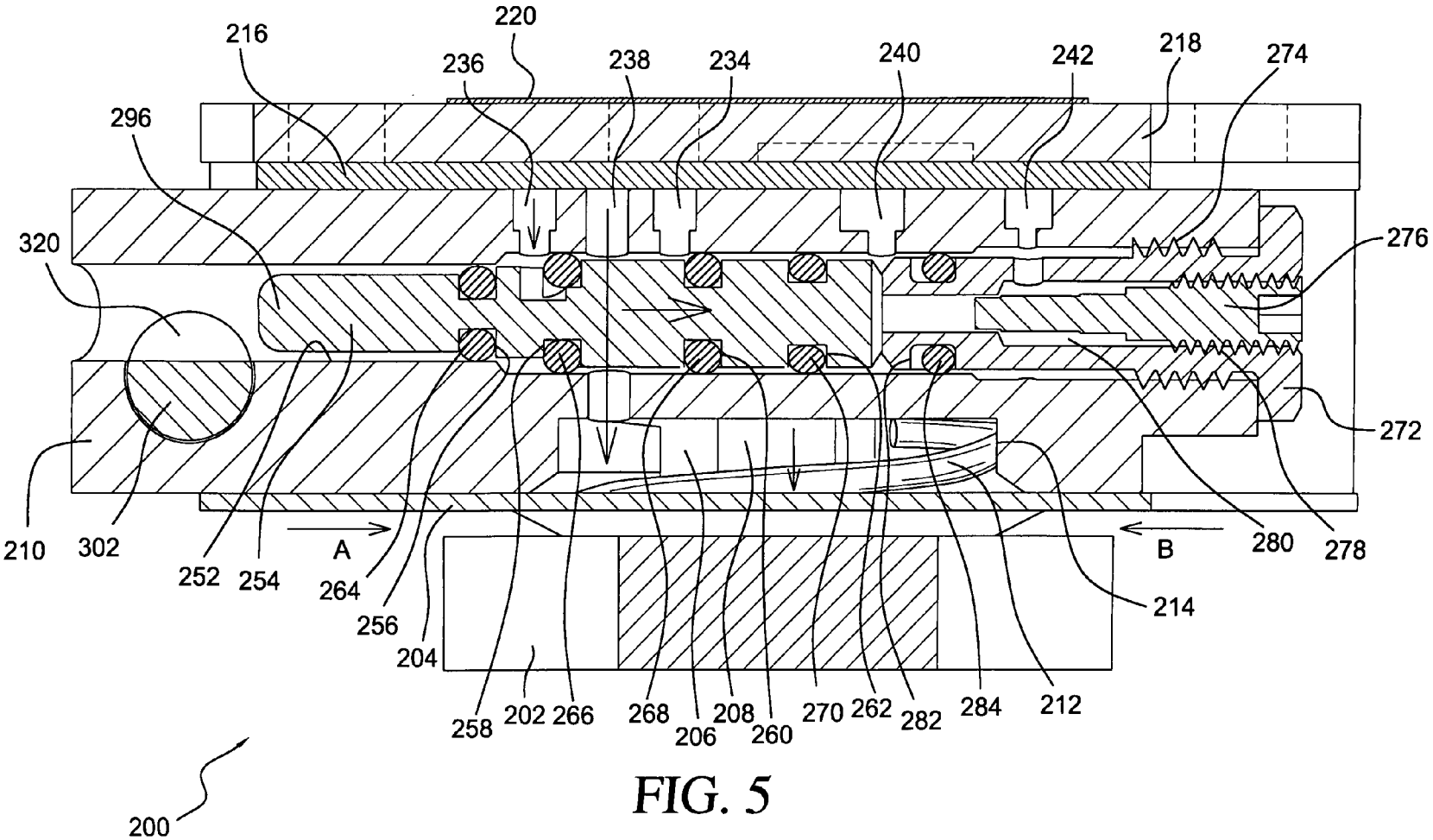
FIG. 5 is a schematic cross-sectional view of the new and improved cap assembly of the present invention showing the various component parts disposed at their original, normal, default, or start positions when the fastener-driving tool is fluidically connected to the source of compressed air but prior to the depression or actuation of the trigger mechanism.

With reference now being specifically made, for example, to FIGS. 2 and 5, it is further seen that the diaphragm member 204 is provided with a trigger port 230 and a reservoir port 232, while in a similar manner, the cap member 210 is provided with a trigger port 234 fluidically connected to the trigger port 230 defined within the diaphragm member 204, a reservoir port 236 fluidically connected to the reservoir port 232 defined within the diaphragm member 204, a diaphragm control port 238, a plenum chamber port 240, and a piston exhaust air signal port 242. It is also seen that the cap member 210 has a piston exhaust air port 244 which is located at a substantially axially central location thereof and which is adapted to be fluidically connected to the axially oriented exhaust passage 208 which is defined within the upstanding post 206, and that a substantially V-shaped exhaust passage 246 is also defined within the upper surface portion of the cap member 210 so as to be fluidically connected to the piston exhaust air port 244 and thereby permit a portion of the piston exhaust air to atmosphere. Still further, the cap gasket 216 is similarly provided with a piston exhaust air port 248 at a substantially axially central region thereof, and a pair of exhaust air signal ports 250 which are defined within the cap gasket 216 upon opposite sides of the piston exhaust air port 248.

It is to be noted that while the pair of exhaust air signal ports 250 are defined within the cap gasket 216 upon opposite sides of the piston exhaust air port 248, the provision of the pair of exhaust air signal ports 250 is for structurally symmetrical purposes only in that only one of such pair of exhaust air signal ports 250 will actually be fluidically connected to the piston exhaust air signal port 242 defined within the cap member 210. In other words, the cap gasket 216 has been constructed so as to be entirely symmetrical about its longitudinal axis so that regardless of whether it is oriented with its upper surface portion, as viewed in FIG. 2, facing upwardly and therefore visible, or if it is effectively inverted such that the visible upper surface portion thereof then becomes the undersurface portion thereof, the cap gasket 216 remains functional. It is to be lastly noted in connection with the various structural components as illustrated within FIG. 2 that the undersurface portion, not visible, of the cap cover 218 is provided with a fluid passageway or path that effectively extends between, and therefore fluidically connects, the piston exhaust air port 248 of the cap gasket 216 and the one of the exhaust air signal ports 250 which is actually fluidically connected to the piston exhaust air signal port 242 defined within the cap member 210.

Continuing still further, and with reference continuing to be made to FIGS. 2 and 5, it is additionally seen that, in accordance with the principles and teachings of the present invention, the new and improved cap assembly 200 further comprises a bore 252 which is defined within the cap member 210 and within which a spool valve 254 is adapted to be movably disposed in a reciprocal manner. The external surface portion of the spool valve 254 is respectively provided with four annular recesses 256, 258, 260, 262, as can best be seen, for example, within FIG. 5, and correspondingly, four annular O-ring members 264, 266, 268, 270 are respectively disposed within the four annular recesses 256, 258, 260, 262 such that the external peripheral surface portions of the four annular O-ring members 264, 266, 268, 270 sealingly engage respective internal peripheral wall portions of the bore 252 defined within the cap member 210. In a similar manner, it is also seen that the right end portion of a needle valve housing 272 has an externally threaded portion which is adapted to be threadedly engaged within an internally threaded right end portion of the bore 252, as at 274 and as viewed within FIG. 5, and that a right end portion of a needle valve 276 has an externally threaded portion which is adapted to be threadedly engaged, as at 278, in an adjustable manner, within a bore 280 defined within the needle valve housing 272 which is internally threaded at its right end portion. The left end external surface portion of the needle valve housing 272 is provided with an annular recess 282, and an annular O-ring member 284 is disposed within the annular recess 282.

With reference lastly being additionally made to FIGS. 3 and 4 with respect to the disclosure of the remaining structure comprising the new and improved cap assembly 200, as well as with respect to the new and improved switch mechanism 300 operatively associated with the new and improved cap assembly 200 of the present invention, it is seen that the new and improved switch mechanism 300 of the present invention comprises a substantially cylindrically-shaped auto-cycle/single-shot operative-mode changeover control pin 302. The changeover control pin 302 is adapted to be movably disposed within a bore 286, which is defined within, and passes through, a corner region of the cap assembly 200, such that the changeover control pin 302 can be disposed at either one of two positions.

As will become more fully appreciated hereinafter with respect to the operative description of the present invention in connection with, and as illustrated within, FIG. 5-7, but as can now be best appreciated from FIG. 3, when the changeover control pin 302 is moved from the lower right position to the upper left position, the fastener-driving tool 100 will be disposed within its single-shot mode of operation, whereas, conversely, when the changeover control pin 302 is moved from the upper left position to the lower right position, the fastener-driving tool 100 will be disposed within its fully automatic continuous firing mode of operation. Still further, as can also be appreciated from FIG. 3, it is also seen that the changeover control pin 302 is movable along a linear locus 304 which is substantially perpendicular to the linear locus 288 defined by means of the spool valve 254, the needle valve housing 272, and the needle valve 276.

More particularly, with reference still being made to FIGS. 3 and 4, it is seen that the right end external peripheral surface portion of the changeover control pin 302 is provided with a pair of adjacent annular recesses 306, 308, and that a detent ball 310, biased means of a suitable coil spring member 312, is adapted to be disposed within a particular one of the annular recesses 306,308, so as to effectively determine or define the selected firing mode of operation of the fastener-driving tool 100. In particular, for example, when the changeover control pin 302 is moved to its rightmost position as viewed, for example, within FIG. 4, the detent ball 310 will be disposed within the leftward one of the pair of annular recesses 306 whereby, as will become more apparent hereinafter, the fastener-driving tool 100 will be disposed in its fully automatic continuous firing mode of operation, whereas, conversely, when the changeover control pin 302 is moved to its leftmost position as, for example, within FIG. 4, the detent ball 310 will be disposed within the rightward one of the pair of annular recesses 308 whereby, as will become more apparent hereinafter, the fastener-driving tool 100 will be disposed in its single-shot firing mode of operation. It is also seen that a cap member 314 is fixedly secured upon the right end portion of the changeover control pin 302, by means of, for example, a suitable screw or bolt fastener 316 which is adapted to be threadedly engaged within the right end portion of the changeover control pin 302, whereby the cap member 314 effectively serves two purposes.

A first purpose served by means of the cap member 314 is that it effectively serves as a handle by means of which, for example, the tool operator can move the changeover control pin 302 between its leftward and rightward positions. The second purpose served by means of the cap member 314 is that it effectively serves as a stop mechanism in that the cap member 314 will engage an external surface portion of the cap member 210 such that the changeover control pin 302 cannot be moved beyond its leftmost position, defining the single-shot firing mode of operation of the fastener-driving tool 100, and thereby become separated from the cap assembly 200 as a result of effectively being pushed completely through, and out from, the bore 286 defined within the cap assembly 200. In a similar manner, it is also seen that the left external surface portion of the changeover control pin 302 is provided with an outwardly extending or projecting lug 318, and this lug 318 similarly serves as a stop mechanism, as a result of engaging or contacting an interior portion, not shown, of the cap member 210 so as to prevent the tool operator from moving the changeover control pin 302 beyond its rightmost position, defining the fully automatic continuous firing mode of operation of the fastener-driving tool 100, whereby, again, the entire switch mechanism 300 could become separated from the cap assembly 200. Lastly, it is also seen that an external surface portion of the changeover control pin 302, located at a substantially axially central portion thereof, is provided with a cut-out region 320 for a purpose which will be more fully explained hereinafter.

Figure 6:
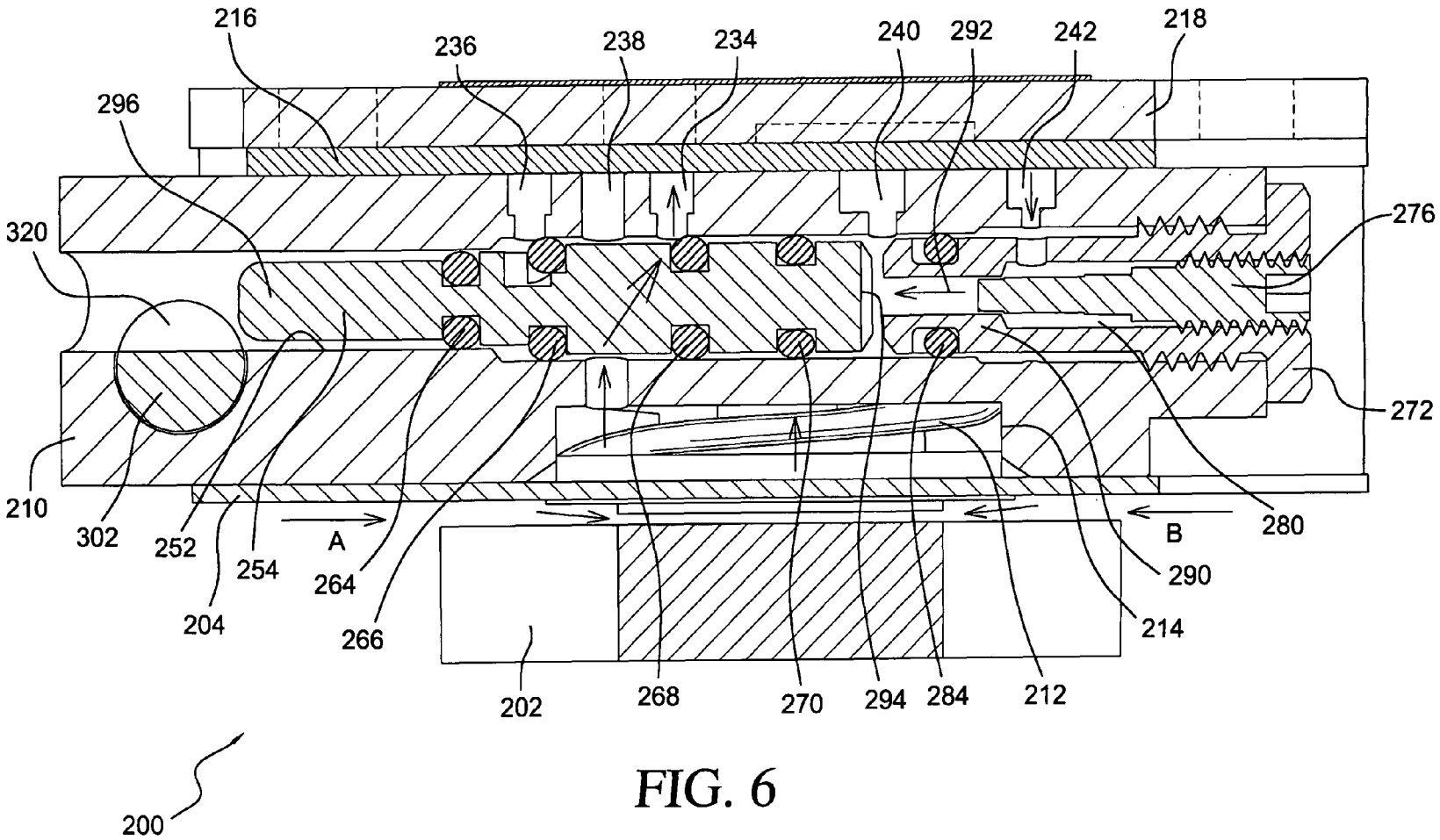
FIG. 6 is a schematic cross-sectional view of the new and improved cap assembly of the present invention, similar to that of FIG. 5, showing, however, the various component parts disposed at their respective positions immediately after the trigger mechanism has been depressed or actuated so as to commence the movement of the valve spool so as to permit the fastener-driving tool to in fact operate in accordance with its fully automatic continuous firing mode of operation.
Figure 7:
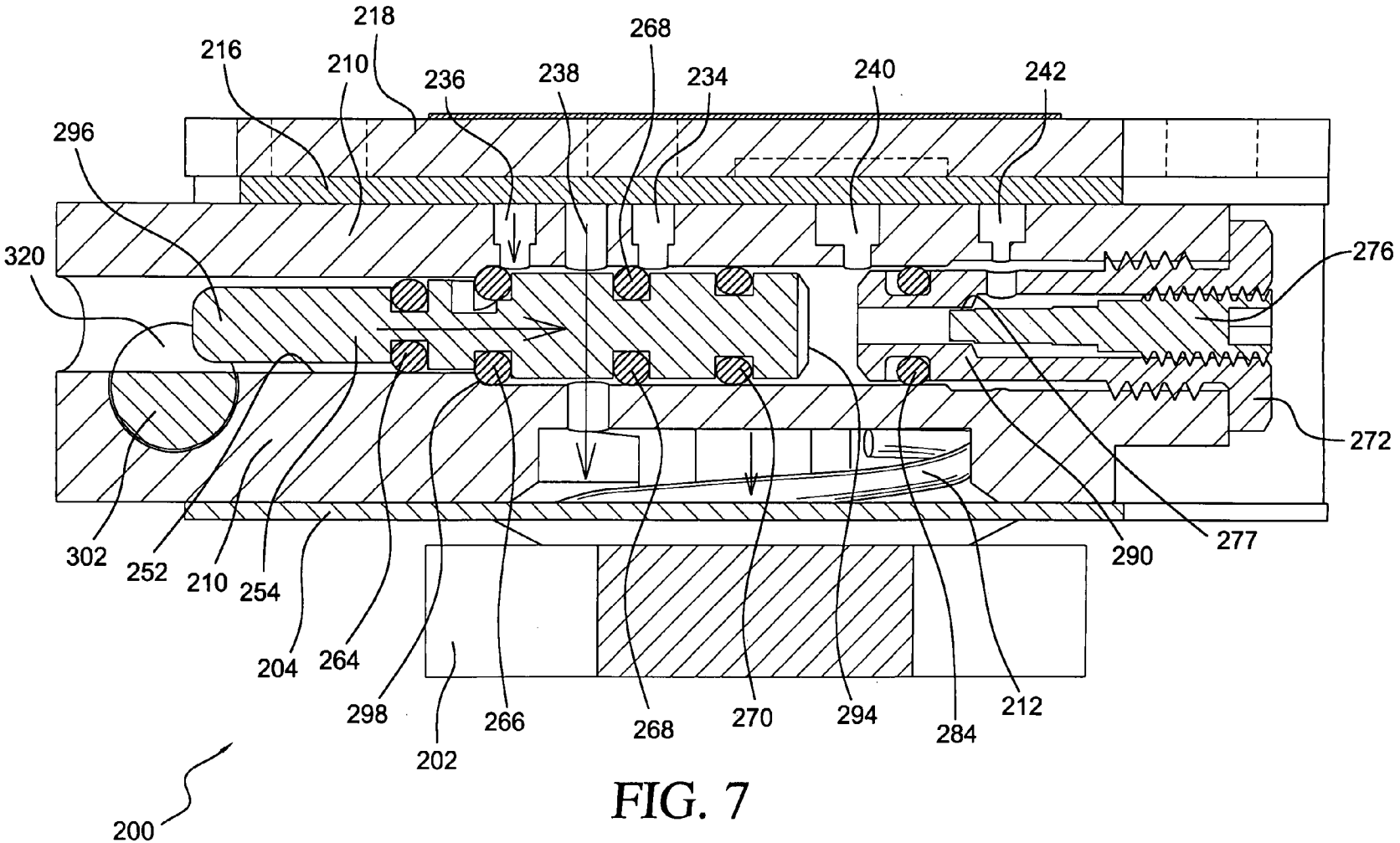
FIG. 7 is a schematic cross-sectional view of the new and improved cap assembly of the present invention, similar to that of FIG. 6, showing, however, the various component parts disposed at their respective positions immediately after the trigger mechanism has been depressed or actuated and after the valve spool has moved toward its leftmost extreme position and is ready to return toward its rightmost extreme or original position so as to permit the fastener-driving tool to in fact continue to operate in accordance with its fully automatic continuous firing mode of operation.

Having described substantially all of the structural components comprising the new and improved cap assembly 200 of the present invention, as well as substantially all of the structural components comprising the new and improved fastener-driving tool mode of operation switch mechanism 200, an operation of the fastener-driving tool 100, when the same is being operated in either its fully automatic continuous firing mode of operation, or in its single-shot firing mode of operation, will now be described as a result of reference being additionally made to FIGS. 5-7. More particularly, when the fastener-driving tool 100 has been operatively and fluidically connected to the source of compressed air, whereby the fastener-driving tool 100 will be disposed in a ready-to-fire mode or state, and when the new and improved switch mechanism 300 has been moved to its lower right position, as illustrated within FIG. 3, so as to permit the fastener-driving tool 100 to be fired in accordance with its fully automatic continuous firing mode of operation, the various component parts thereof will be disposed at their respective default, original, or start positions as disclosed within FIG. 5.

For example, line pressure, supplied to the fastener-driving tool 100 by means of the compressed air line 108 operatively and fluidically connected to the compressed air source, will be supplied to the reservoir port 236 of the cap member 210 through means of the reservoir port 232 defined within the diaphragm member 204, and the trigger port 234 of the cap member 210 through means of the trigger port 230 defined within the diaphragm member 204. It is noted that the line pressure fluidically connected to the trigger port 234 of the cap member 210 would normally tend to flow outwardly through the trigger port 234 to atmosphere, however, since the trigger mechanism of the fastener-driving tool 100 has not as yet been depressed or actuated, such line pressure air cannot actually be exhausted through the trigger port 234, and in fact, since the trigger port 234 defined within the cap member 210 is fluidically connected to the diaphragm control port 238 as a result of the annular space defined between the external peripheral surface portion of the spool valve 254 and the internal peripheral surface portion of the bore 252 defined within the cap member 210, as well as the relative disposition of the annular O-ring members 266, 268 with respect to the trigger port 234 and the diaphragm control port 238, line pressure air will tend to flow through the diaphragm control port 238 of the cap member 210 and toward the diaphragm member 204 so as to pressurize the diaphragm member 204 and move the same downwardly. In addition, it is noted that line pressure will also be supplied to the inside of the tool whereby such line pressure tends to flow within the space defined between the diaphragm member 204 and the rubber gasket 202, and toward the piston cylinder of the fastener-driving tool 100, as schematically illustrated by means of the oppositely oriented arrows A,B within FIG. 5, the piston cylinder of course being incorporated within the upper housing portion 102 of the fastener-driving tool 100 and having, in turn, incorporated therein, the working piston and the fastener-driving blade member, also not shown, for actually driving a fastener out from the fastener-driving tool 100.

It is noted, however, that when the various component parts of the fastener-driving tool 100 are disposed at their respective positions as illustrated within FIG. 5, the supply of such line pressure, as schematically illustrated by means of the oppositely oriented arrows A,B within FIG. 5, and disposed within the space defined between the diaphragm member 204 and the rubber gasket 202, cannot actually enter the piston cylinder of the fastener-driving tool 100, and thereby cannot force the working piston and the driver blade mechanism to move in their downward directions. This is because the biasing force of the coil spring member 212, as well as the supply of the compressed air from the diaphragm control port 238, are acting downwardly upon the diaphragm member 204 whereby the axially central portion of the diaphragm member 204 is forced into contact with the upper surface portion of the rubber gasket 202 thereby effectively sealing off the upper end portion of the piston cylinder from the ingress of the compressed air line pressure. Accordingly, the tool cannot, and will not, be fired.

However, when the fastener-driving tool 100 is desired to be fired so as to fire or discharge fasteners outwardly therefrom in accordance with its fully automatic continuous firing mode of operation, and assuming that the workpiece contact element of the fastener-driving tool 100 has been disposed in contact with and depressed against the workpiece or substrate, then when the trigger mechanism of the fastener-driving tool 100 is pulled or depressed, air is exhausted through means of the trigger mechanism and the trigger port 234 defined within the cap member 210 such that the air pressure disposed above the diaphragm member 204 is now effectively reduced or exhausted, it being remembered that the trigger port 234 is in fluidic communication with the diaphragm control port 238 by means of the annular spacing defined between the external peripheral surface portion of the spool valve 254 and the internal peripheral surface portion of the bore 252 defined within the cap 210, as well as a result of the relative disposition of the annular O-ring members 266, 268. Accordingly, since the coil spring member 212 does not exert a sufficiently strong biasing force, by itself, against the diaphragm member 204, so as to maintain the diaphragm member 204 at its lowered or depressed position as has been illustrated within FIG. 5, the diaphragm member 204 will effectively be permitted to be moved upwardly to its upper or elevated position as illustrated within FIG. 6 whereby the compressed air line pressure, being supplied toward the piston cylinder of the fastener-driving tool 100 as a result of flowing within the space defined between the diaphragm 204 and the rubber gasket 202, as schematically illustrated by means of the oppositely oriented arrows A,B within FIG. 5, can now actually enter the piston cylinder of the fastener-driving tool 100 and thereby force the working piston and the driver blade mechanism to move in their downward directions so as to, in turn, drive a fastener out from the fastener-driving tool 100.

At the same time that the line pressure, as schematically illustrated by means of the oppositely oriented air flows A,B are actuating the working piston downwardly, such line pressure also begins to flow upwardly through the diaphragm 204, that is, more particularly, through the fluid passageway 208 of the upstanding post 206, and the piston exhaust air port 244 defined within the cap member 210. While some of this line pressure is vented to atmosphere from the piston exhaust air port 244 through means of the V-shaped exhaust passage 246, a portion of such line pressure air is also fluidically conducted upwardly through the piston exhaust air port 248 defined within the cap gasket 216. Continuing further, this portion of the line pressure air is further conducted through the aforenoted passageway, not shown, defined upon the undersurface portion of the cap cover 218 so as to effectively be routed back downwardly toward and through the left one of the air signal ports 250 defined within the cap gasket 216 and thereby, in turn, be fluidically conducted into the piston exhaust air signal port 242 defined within the cap member 210 as can also be seen in FIG. 6. As a result of such line pressure air being conducted into and through the piston exhaust air signal port 242, such signal air is then conducted into the bore 280 defined within the needle valve housing 272 so as to enter the annular space defined between the left end external surface portion of the needle valve 276 and the internal surface portion of the needle valve housing 272.

It is also seen that the leftmost end portion of the needle valve 276 is disposed within a stepped-down or radially inwardly diminished portion 290 of the needle valve housing 272, however, sufficient annular space is defined between the leftmost end portion of the needle valve 276 and the stepped-down or radially inwardly diminished portion 290 of the needle valve housing 272 so as to, in effect, permit a control signal, denoted by means of the arrow 292, to be fluidically conducted toward, and there-by act upon, the right end face 294 of the spool valve 254. Part of such control signal air also enters the plenum chamber port 240, and together, the air volumes will act upon the spool valve 254 so as to begin to move the spool valve 254 toward the left so as to ultimately attain the position illustrated within FIG. 7, which is permitted as a result of the left end portion 296 of the spool valve 254 being aligned with the cut-out region 320 of the changeover control pin 302.

When the various components of the new and improved cap assembly 200 and the new and improved switch mechanism 300 are then disposed at their respective positions illustrated within FIG. 7, it is noted that the left end portion 296 of the spool valve 254 will effectively be disposed within the cut-out region 320 of the changeover control pin 302, and in addition, as a result of the leftward movement of the spool valve 254 from its position illustrated within FIG. 6 to its position illustrated within FIG. 7, the annular O-ring member 268 is now inter-posed between the trigger port 234 and the diaphragm control port 238 so as to effectively close off or block the trigger port 234 whereby the diaphragm control port 238 will effectively be fluidically disconnected from the trigger port 234 so that the air disposed above the diaphragm member 204 is no longer exhausted through the trigger port 234. In addition, it is noted that the diaphragm control port 238 will now effectively be fluidically connected to the reservoir port 236 through means of the annular space defined between the external peripheral surface portion of the spool valve 254 and the internal peripheral surface portion of the bore 252 defined within the cap 210. Accordingly, the line pressure air is again conducted from the diaphragm control port 238 toward the diaphragm 204 so as to again force the diaphragm 204 into contact with the rubber gasket 202 and thereby prevent the line pressure air from entering the working piston cylinder. Therefore, the working piston is permitted to rise within the working piston cylinder, and the air disposed above the working piston will, in effect, be dissipated to atmosphere through means of the fluid passageway 208 defined within the upstanding post 206, the piston exhaust air port 244 defined within the cap member 210, and the V-shaped exhaust passage 246, as well as through the piston exhaust air signal port 242 so as to act upon the valve spool 254.

Eventually, however, as the working piston is fully returned to its uppermost original or start position, exhaust air, previously disposed above the working piston and being forced upwardly as a result of the working piston moving through its return stroke, is no longer conducted through the piston exhaust air signal port 242 and the annular space defined between the left end external surface portion of the needle valve 276 and the internal surface portion of the needle valve housing 272, and accordingly, the control signal 292 is no longer generated. Therefore a relatively low pressure region now exists between the left end portion of the needle valve housing 272 and the right end portion of the spool valve 254. In addition, the spool valve 254 has attained its leftmost position, as illustrated within FIG. 7, as defined by means, for example, of the annular O-ring member 266 being disposed in abutment with the radially inwardly extending annular shoulder portion 298 of the cap member 210, and therefore, the line pressure air, from reservoir port 236 and disposed within the annular space defined between the external peripheral surface portion of the spool valve 254 and the internal peripheral surface portion of the bore 252 defined within the cap 210, will tend to move the spool valve 254 back toward the right so as to again attain the position illustrated within FIG. 5. Accordingly, as a result of such rightward movement of the spool valve 254 back to its original position as illustrated within FIG. 5, the annular O-ring member 268 is again disposed upon the opposite side of the trigger port 234 from that illustrated within FIG. 7 so as to effectively open or unblock the trigger port 234 and thereby again fluidically connect the diaphragm control port 238 to the trigger port 234. Since the trigger mechanism is being maintained at its depressed or actuated position, as is the workpiece contact element, such line pressure is again exhausted through means of the trigger port 234 whereby another firing cycle can be commenced. Accordingly, as long as the trigger mechanism and the workpiece contact element are disposed at their depressed or actuated positions, the fastener-driving tool will be disposed in its fully automatic continuous firing mode of operation.

Lastly, with respect to the operation of the fastener-driving tool 100 in its fully automatic continuous firing mode of operation, depending upon the extent to which the needle valve 276 is threadedly engaged within, or threadedly disengaged from, the needle valve housing 272, the rate of oscillation of the spool valve 254, and therefore, the rate of firing of the fastener-driving tool 100, can be varied. More particularly, it is to be noted that the radially inwardly diminished internal peripheral surface portion 290 of the needle valve housing 272, as well as the external peripheral surface portion of the leftmost end portion 277 of the needle valve 276, are progressively tapered such that when the needle valve 276 is progressively unthreaded with respect to, or out from, the needle valve housing 272, the annular space defined between the radially inwardly diminished internal peripheral surface portion 290 of the needle valve housing 272 and the external peripheral surface portion of the leftmost end portion 277 of the needle valve 276 is progressively increased thereby effectively enhancing the volume, strength, and speed of the control signal 292, and therefore the rate of oscillation of the valve spool 254, whereas, to the contrary, when the needle valve 276 is progressively threaded into the needle valve housing 272, the annular space defined between the radially inwardly diminished internal peripheral surface portion 290 of the needle valve housing 272 and the external peripheral surface portion of the leftmost end portion 277 of the needle valve 276 is progressively decreased thereby effectively diminishing the volume, strength, and speed of the control signal 292 and the rate of oscillation of the valve spool 254. These relatively faster and slower adjustment modes are also schematically illustrated within FIG. 3.

Lastly, when it is desired to operate the fastener-driving tool 100 in its single-shot firing mode of operation, the changeover control pin 302 of the new and improved switch mechanism 300 is moved in the direction extending from the lower right as viewed within FIG. 3 to the upper left. Accordingly, it will be appreciated that the left end portion 296 of the spool valve 254 will no longer be effectively aligned with the cut-out region 320 of the changeover control pin 302, but, to the contrary, will effectively be aligned with, and will contact, a solid portion 322 of the changeover control pin 302. Accordingly, when the fastener-driving tool 100 is fired as a result of the trigger mechanism being actuated or depressed, the trigger port 234 will be opened, the air disposed above diaphragm member 204 will be permitted to be exhausted, the diaphragm member 204 will be moved upwardly to the position illustrated within FIG. 6, and the compressed air line pressure, being supplied toward the piston cylinder of the fastener-driving tool 100 as a result of flowing within the space defined between the diaphragm 204 and the rubber gasket 202, as schematically illustrated by means of the oppositely oriented arrows A,B within FIG. 5, can now actually enter the piston cylinder of the fastener-driving tool 100 and thereby force the working piston and the driver blade mechanism to move in their downward directions so as to, in turn, drive a fastener out from the fastener-driving tool 100.

However, as the working piston tends to move back upwardly and generate the control signal 292 through the piston exhaust air signal port 242, as has been previously noted, since the left end portion 296 of the spool valve 254 is no longer effectively aligned with the cut-out region 320 of the changeover control pin 302, but, to the contrary, is effectively aligned with, and will contact, the solid portion 322 of the changeover control pin 302, any control signal generated through means of the air signal port 242 will not have any significant impact upon the spool valve 254, that is, such control signal will not move the valve spool 254 toward the left since spool valve 254 cannot in fact attain the position illustrated, for example, within FIG. 7 since it will encounter the solid portion 322 of the changeover control pin 302. Accordingly, the disposition of the spool valve 254 will effectively be confined to the position illustrated, for example, within FIGS. 5 and 6. Therefore, the annular O-ring member 268 never closes off or blocks the trigger port 234, and the trigger port 234 is always maintained in fluidic communication with the diaphragm control port 238 so as to permit the line pressure air, as illustrated by means of the arrows A,B, to always be acting upon the working piston thereby effectively preventing the working piston from moving back upwardly, or returning, to its original position.

Therefore, in order to effectively recycle the fastener-driving tool 100 in order to permit the fastener-driving tool 100 to undergo another fastener-firing cycle, after the trigger mechanism, for example, has been depressed or actuated so as to fire the fastener-driving tool 100 as a result of the fluid circuitry disclosed within FIG. 6 and previously discussed, the trigger mechanism must be released so as to effectively close the trigger port 234 in order to prevent the exhaust or loss of the line pressure air, and the diaphragm control air disposed above the diaphragm member 204, through the trigger port 234. The line pressure air present within the trigger port 234 will now be able to fluidically flow through the diaphragm control port 238 and pressurize the diaphragm 204 to its downward position, as illustrated within FIG. 5, thereby preventing the ingress of line pressure air into the piston cylinder chamber, as schematically illustrated by arrows A,B, and the piston will be able to return upwardly as a result of the exhaust of the air from within the piston cylinder chamber through the fluid passageway 208 defined within the upstanding post 206 associated with the diaphragm 204, and out to atmosphere through the piston exhaust air port 244 and the V-shaped exhaust passage 246 defined within the cap member 210. Therefore, the various component parts of the fastener-driving tool 100 will be disposed at their original or start positions illustrated within FIG. 5. Accordingly, the fastener-driving tool 100 can once again be fired in accordance with its single-shot mode of operation.

Thus, it may be seen that in accordance with the principles and teachings of the present invention, there has been provided a fastener-driving tool which is provided with a new and improved cap assembly which has incorporated therein a new and improved switch mechanism which permits the fastener-driving tool to be operated in one of two firing modes of operation. The new and improved switch mechanism comprises a two-position switch mechanism such that when the new and improved switch mechanism is disposed at a first one of its two positions, the fastener-driving tool will be able to operate in a fully automatic continuous firing mode of operation by means of which the fastener-driving tool can continuously fire fasteners into a substrate or workpiece as long as the workpiece contact element is maintained at its engaged or depressed position against the workpiece or substrate, and as long as the trigger mechanism is likewise maintained at its actuated or depressed position, or alternatively, when the new and improved switch mechanism is disposed at a second one of the two positions, the fastener-driving tool can be operated in a one-shot firing mode by means of which the fastener-driving tool can only fire a single fastener either in accordance with, for example, a sequential-firing mode of operation or a bump-firing mode of operation. In addition, the new and improved cap assembly also has incorporated therein an adjustment mechanism such that when the switch mechanism is disposed at the first one of its two positions so as to permit the fastener-driving tool to be operated in its fully automatic continuous firing mode of operation, the rate at which the fastener-driving tool can be continuously fired can be adjusted.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A cap assembly for a fastener-driving tool having a working piston, disposed within a piston-cylinder chamber, for discharging a fastener from the fastener-driving tool when the working piston is subjected to actuating air, comprising:

a cap member;

a plurality of fluid ports defined within said cap member for permitting actuating air to be conducted toward the working piston of the fastener-driving tool in order to actuate the working piston;

fasteners for securing said cap member upon the fastener-driving tool;

a spool valve reciprocally movable within said cap member between first and second positions so as to permit said plurality of fluid ports to be fluidically connected in a predetermined manner so as to permit the fastener driving tool to be operated within two different modes of operation; and a switch mechanism incorporated within said cap member, and movable between first and second positions, for effectively permitting said spool valve to move reciprocally between its first and second positions in order to permit the fastener-driving tool to be operated within a first one of said two different modes of operation when said switch mechanism is disposed at its first position, and for effectively preventing said spool valve from moving reciprocally between its first and second positions so as to permit the fastener-driving tool to be operated only within a second one of said two different modes of operation.

2. The cap assembly as set forth in claim 1, wherein:

when said two-position switch mechanism is disposed at said first one of said two positions, the fastener-driving tool can be operated within a fully automatic continuous firing mode of operation, whereas when said two-position switch mechanism is disposed at said second one of said two positions, the fastener-driving tool can be operated within a single-shot mode of operation.

3. The cap assembly as set forth in claim 2, wherein:

a diaphragm member is movable between a first position at which said diaphragm member will effectively prevent actuating air from flowing into the piston-cylinder chamber of the fastener-driving tool so as to be incapable of actuating the working piston, and a second position at which said diaphragm member will effectively permit actuating air to flow into the piston-cylinder chamber of the fastener-driving tool so as to be capable of actuating the working piston;

a first one of said plurality of fluid ports comprises a reservoir port defined within said cap member so as to be fluidically connected to a source of the actuating air;

a second one of said plurality of fluid ports comprises a trigger port defined within said cap member so as to be fluidically connected to the source of the actuating air; and a third one of said plurality of fluid port comprises a diaphragm control port defined within said cap member for conducting actuating air toward said diaphragm member in order to normally bias said diaphragm member toward said first position when said diaphragm control port is fluidically connected to either one of said reservoir and trigger ports.

4. The cap assembly as set forth in claim 3, wherein:

said spool valve is reciprocally movable within said cap member between said first position at which said trigger port is fluidically connected to said diaphragm control port, and said second position at which said reservoir port is fluidically connected to said diaphragm control port.

5. The cap assembly as set forth in claim 4, wherein:

said switch mechanism comprises a two-position changeover control pin wherein when said two-position changeover control pin is disposed at said first one of said two positions, said two-position changeover control pin will permit said spool valve to be reciprocally moved between said two positions in accordance with a repetitive operative cycle so as to, in turn, permit the fastener-driving tool to be operated within its fully automatic continuous firing mode of operation, whereas when said two-position changeover control pin is disposed at said second one of said two positions, said two-position changeover control pin will prevent said spool valve from being reciprocally moved between said two positions whereby the fastener-driving tool can only be operated within its single-shot mode of operation.

6. The cap assembly as set forth in claim 4, further comprising:

a control air signal port defined within said cap member for providing a control air signal to be conducted toward said spool valve; and fluid passageway means defined within said diaphragm member and said cap member for conducting actuating air through said control air signal port in order to generate said control air signal so as to move said spool valve from said first position to said second position.

7. The cap assembly as set forth in claim 6, further comprising:

adjustment structure defined within said cap member for adjusting said control air signal in order to, in turn, adjust the cyclical reciprocal rate of movement of said spool valve between said first and second positions.

8. A fastener-driving tool having a working piston, disposed within a piston-cylinder chamber, for discharging a fastener from the fastener-driving tool when the working piston is subjected to actuating air, comprising:

a cap member;

a plurality of fluid ports defined within said cap member for permitting actuating air to be conducted toward said working piston of said fastener-driving tool in order to actuate said working piston;

fasteners for securing said cap member upon said fastener-driving tool;

a spool valve reciprocally movable within said cap member between first and second positions so as to permit said plurality of fluid ports to be fluidically connected in a predetermined manner so as to permit said fastener driving tool to be operated within two different modes of operation; and a switch mechanism incorporated within said cap member, and movable between first and second positions, for effectively permitting said spool valve to move reciprocally between its first and second positions in order to permit said fastener-driving tool to be operated within a first one of said two different modes of operation when said switch mechanism is disposed at its first position, and for effectively preventing said spool valve from moving reciprocally between its first and second positions so as to permit said fastener-driving tool to be operated only within a second one of said two different modes of operation.

9. The fastener-driving tool as set forth in claim 8, wherein:

when said two-position switch mechanism is disposed at said first one of said two positions, said fastener-driving tool can be operated within a fully automatic continuous firing mode of operation, whereas when said two-position switch mechanism is disposed at said second one of said two positions, said fastener-driving tool can be operated within a single-shot mode of operation.

10. The fastener-driving tool as set forth in claim 9, wherein:

a diaphragm member is movable between a first position at which said diaphragm member will effectively prevent actuating air from flowing into said piston-cylinder chamber of said fastener-driving tool so as to be incapable of actuating the working piston, and a second position at which said diaphragm member will effectively permit actuating air to flow into said piston-cylinder chamber of said fastener-driving tool so as to be capable of actuating said working piston;

a first one of said plurality of fluid ports comprises a reservoir port defined within said cap member so as to be fluidically connected to a source of the actuating air;

a second one of said plurfality of fluid ports comprises a trigger port defined within said cap member so as to be fluidically connected to the source of the actuating air; and a third one of said plurality of fluid ports comprises a diaphragm control port defined within said cap member for conducting actuating air toward said diaphragm member in order to normally bias said diaphragm member toward said first position when said diaphragm control port is fluidically connected to either one of said reservoir and trigger ports.

11. The fastener-driving tool as set forth in claim 10, wherein:

said spool valve reciprocally movable within said cap member between said first position at which said trigger port is fluidically connected to said diaphragm control port, and said second position at which said reservoir port is fluidically connected to said diaphragm control port.

12. The fastener-driving tool as set forth in claim 11, wherein:

said switch mechanism comprises a two-position changeover control pin wherein when said two-position changeover control pin is disposed at said first one of said two positions, said two-position changeover control pin will permit said spool valve to be reciprocally moved between said two positions in accordance with a repetitive operative cycle so as to, in turn, permit said fastener-driving tool to be operated within its fully automatic continuous firing mode of operation, whereas when said two-position changeover control pin is disposed at said second one of said two positions, said two-position changeover control pin will prevent said spool valve from being reciprocally moved between said two positions whereby said fastener-driving tool can only be operated within its single-shot mode of operation.

13. The fastener-driving tool as set forth in claim 11, further comprising:

a control air signal port defined within said cap member for providing a control air signal to be conducted toward diaphragm member and said cap member for conducting actuating air through said control air signal port in order to generate said control air signal so as to move said spool valve from said first position to said second position.

14. The fastener-driving tool as set forth in claim 13, further comprising:

adjustment structure defined within said cap member for adjusting said control air signal in order to, in turn, adjust the cyclical reciprocal rate of movement of said spool valve between said first and second positions.

15. A method of operating a fastener-driving tool, having a working piston disposed within a piston-cylinder chamber for discharging a fastener from the fastener-driving tool when the working piston is subjected to actuating air, such that said fastener-driving tool is capable of being actuated in accordance with two different modes of operation, comprising the steps of: actuating air, such that said fastener-driving tool is capable of being actuated in accordance with two different modes of operation, comprising the steps of:

providing said fastener-driving tool with a cap member;

providing said cap member with a plurality of fluid ports for permitting actuating air to be conducted toward said working piston of said fastener-driving tool in order to actuate said working piston;

securing said cap member upon said fastener-driving tool;

incorporating a spool valve such that said spool valve is reciprocally movable within said cap member between first and second positions so as to permit said plurality of fluid ports to be fluidically connected in a predetermined manner so as to permit said fastener driving tool to be operated within two different modes of operation; and incorporating a switch mechanism within said cap member such that said switch mechanism is movable between first and second positions, for effectively permitting said spool valve to move reciprocally between its first and second positions in order to permit said fastener-driving tool to be operated within a first one of said two different modes of operation when said switch mechanism is disposed at its first position, and for effectively preventing said spool valve from moving reciprocally between its first and second positions so as to permit the fastener-driving tool to be operated only within a second one of said two different modes of operation.

16. The method as set forth in claim 15, further comprising the step of:

when said two-position switch mechanism is disposed at said first one of two positions, said fastener-driving tool can be operated within a fully automatic continuous firing mode of operation;

whereas when said two-position switch mechanism is disposed at said second one of said two positions, said fastener-driving tool can be operated within a single-shot mode of operation.

17. The method as set forth in claim 16, further comprising the steps of:

providing a diaphragm member which is movable between a first position at which said diaphragm member will effectively prevent actuating air from flowing into said piston-cylinder chamber of said fastener-driving tool so as to be incapable of actuating the working piston, and a second position at which said diaphragm member will effectively permit actuating air to flow into said piston-cylinder chamber of said fastener-driving tool so as to be capable of actuating the working piston;

providing a first one of said plurality of fluid ports as a reservoir port within said cap member so as to be fluidically connected to a source of said actuating air;

providing a second one of said plurality of fluid ports as a trigger port within said cap member so as to be fluidically connected to the source of the actuating air;

providing a third one of said plurality of fluid ports as a diaphragm control port within said cap member for conducting actuating air toward said diaphragm member in order to normally bias said diaphragm member toward said first position when said diaphragm control port is fluidically connected to either one of said reservoir and trigger ports;

providing said spool valve within said cap member so as to be reciprocally movable between said first position at which said trigger port is fluidically connected to said diaphragm control port, and said second position at which said reservoir port is fluidically connected to said diaphragm control port; and providing a control air signal port within said cap member for providing a control air signal to said spool valve in order to control the reciprocal movement of said spool valve between said first and second positions.

18. The method as set forth in claim 17, further comprising the step of:

moving said switch mechanism to said first one of said two positions such that said switch mechanism permits said spool valve to be reciprocally moved between said first and second positions whereby said fastener-driving tool can be operated within said fully automatic continuous firing mode of operation.

19. The method as set forth in claim 18, further comprising the step of:

providing adjustment structure within said cap member for adjusting said control air signal so as to, in turn, adjust the cyclical reciprocal rate of movement of said spool valve between said first and second positions.

20. The method as set forth in claim 17, further comprising the step of:

moving said switch mechanism to said second one of said two positions such that said switch mechanism prevents said spool valve from moving between said first and second positions whereby said fastener-driving tool can only be operated within said single-shot firing mode of operation.

* * * * *